US007860419B2

(12) United States Patent
Tateishi et al.

(10) Patent No.: US 7,860,419 B2
(45) Date of Patent: Dec. 28, 2010

(54) ROLLER TEMPERATURE CONTROL METHOD OF IMAGE FORMING APPARATUS AND IMAGE FORMING APPARATUS

(75) Inventors: Yoshinobu Tateishi, Nara (JP); Atsushi Ide, Nara (JP); Koji Aoki, Nara (JP); Toshiya Mikita, Osaka (JP); Hiroaki Hori, Kyoto (JP); Toyoaki Nanba, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 269 days.

(21) Appl. No.: 11/851,513

(22) Filed: Sep. 7, 2007

(65) Prior Publication Data

US 2008/0063419 A1 Mar. 13, 2008

(30) Foreign Application Priority Data

Sep. 13, 2006 (JP) ..... 2006-248398

(51) Int. Cl.
*G03G 15/20* (2006.01)

(52) U.S. Cl. ..... 399/70

(58) Field of Classification Search ..... 399/44, 399/67, 69, 70, 328, 330, 331
See application file for complete search history.

(56) References Cited

U.S. PATENT DOCUMENTS

2004/0131374 A1* 7/2004 Sakai ..... 399/68
2004/0258427 A1* 12/2004 Takahashi ..... 399/69
2005/0207775 A1* 9/2005 Yokono ..... 399/69
2006/0088326 A1* 4/2006 Nakayama ..... 399/69
2007/0110467 A1* 5/2007 Ohno et al. ..... 399/70

FOREIGN PATENT DOCUMENTS

JP 08-220929 8/1996
JP 08-278721 10/1996
JP 10268700 A * 10/1998
JP 2000235324 A * 8/2000
JP 2002174980 A * 6/2002

OTHER PUBLICATIONS

Machine English Translation of JP10-268700.*
Machine English Translation of JP2000-235324.*
Machine English Translation of JP2002-174980.*

* cited by examiner

*Primary Examiner*—David M Gray
*Assistant Examiner*—Billy J Lactaoen
(74) *Attorney, Agent, or Firm*—Renner, Otto, Boisselle & Sklar, LLP

(57) ABSTRACT

In one embodiment, an operation state, standby state or installation environment of an image forming apparatus is detected or determined, and details of heating control of the surface temperature of rollers of a fixing apparatus are changed in accordance with the detected or determined state or environment. For example, when the operation state is a state in which printing on a last sheet of recording paper in a print job is complete, or when the operation state is a state in which printing on recording paper is interrupted, and, in addition, when the installation environment is a low-temperature and low-humidity environment and the image forming apparatus enters the standby state, heating of the rollers is respectively controlled to prevent unexpected and inappropriate changes in the surface temperature of the rollers.

13 Claims, 5 Drawing Sheets

FIG.4

| | Appropriate job temperature | Standby temperature |
|---|---|---|
| Center surface temperature Ta of hot roller | 185°C | 180°C |
| Edge surface temperature Tb of hot roller | 175°C | 160°C |
| Surface temperature Tc of pressure roller | 155°C | 140°C |
| Surface temperature Td of endless external heating belt | 220°C | 200°C |

FIG.5

| Number of sheets of recording paper (A4) | 1～2 | 3～20 | 21～50 | 51～ |
|---|---|---|---|---|
| Correction amount | −10°C | +10°C | +15°C | +15°C |
| After correction | 175°C | 195°C | 200°C | 200°C |

ROLLER TEMPERATURE CONTROL METHOD OF IMAGE FORMING APPARATUS AND IMAGE FORMING APPARATUS

CROSS REFERENCE TO RELATED APPLICATIONS

This application claims priority under 35 U.S.C. §119(a) on Patent Application No. 2006-248398 filed in Japan on Sep. 13, 2006, the entire contents of which are hereby incorporated by reference.

BACKGROUND OF THE INVENTION

1. Field of Invention

The present invention relates to a roller temperature control method of an image forming apparatus by detecting the temperature of a roller of a fixing apparatus and performing heating control of the roller based on the detected temperature, and further relates to an image forming apparatus.

2. Related Art

In image forming apparatuses of electrophotography type, such as a copying machine, a printer and a facsimile, a toner image is formed on the surface of a photosensitive drum by forming an electrostatic latent image on the surface of the photosensitive drum, by supplying toner to the surface of the photosensitive drum from a development apparatus, and then by developing the electrostatic latent images on the surface of the photosensitive drum with the toner, and the toner image is fixed to recording paper by transferring the toner image to the recording paper from the photosensitive drum and by applying heat and pressure to the recording paper.

Among these image forming apparatuses, those that accommodate both color and monochrome are becoming more widespread, and the printing processing speed has been increased for both color and monochrome. More specifically, when using standard A4 size recording paper, the transport speed of the recording paper for color printing processes is set to 41 sheets/minute (a processing speed of 225 mm/sec) and the transport speed of the recording paper for monochrome printing processes is set to 70 sheets/minute (a processing speed of 350 mm/sec), However, when printing is switched to color or the printing processing speed is increased, the maximum power consumption of an image forming apparatus becomes significantly large, and the maximum power consumption almost exceeds the normally allowable level of the commercial alternative current power, and this has been a significant problem.

In image forming apparatuses, the power consumption is the largest in a fixing apparatus that applies heat and pressure to recording paper. In this fixing apparatus, since heat and pressure are applied to the recording paper while it is sandwiched between a hot roller and a pressure roller, a heater for heating a roller is needed, and a large amount of power is consumed due to heat generation from the heater. In addition, when the printing process is in color or its speed is increased, the power consumption of the heater becomes exceptionally large.

Furthermore, since it is necessary to appropriately control the surface temperature of the hot roller and of the pressure roller, a built-in heater may be provided for this purpose within the hot roller and within the pressure roller, or an external heating apparatus may be provided so as to supplementarily heat the rollers. However, since the power consumption becomes extremely large such that it causes, for example, tripping of the breaker of commercial AC power if the heaters of the hot roller and the pressure roller as well as the heater of the external heating apparatus are simultaneously and fully used for heat generation, each heater needs to be appropriately controlled.

For example, in JP H08-220929A, the surface temperature of each roller is switch controlled in accordance with the thickness, size, transport direction, transport interval, and temperature of recording paper and others.

In addition, often times, the surface temperature of each roller is also switch controlled in accordance with the monochrome or color printing process, transport speed of recording paper and others.

Accordingly, the method for controlling the heater of each roller is complicated, and the control method for each heater is switched to no small extent.

However, when the control method for the heater of the hot roller and of the pressure roller as well as of the heater of the external heating apparatus is set to be switched in a complicated manner in accordance with the type and transport speed of recording paper or the printing process type like in the conventional way, the surface temperature of the rollers can sometimes experiences unexpected and inappropriate changes, which has caused fixing deficiencies.

SUMMARY OF THE INVENTION

It is an object of the present invention to provide a roller temperature control method of an image forming apparatus and an image forming apparatus with which it is possible suppress inappropriate changes in the surface temperature of the hot roller and of the pressure roller.

The roller temperature control method of an image forming apparatus according to the present invention is a roller temperature control method of an image forming apparatus having a printing process portion (printing process means) that forms a toner image on recording paper and a fixing apparatus that, fixes the toner image on the recording paper by sandwiching the recording paper between a hot roller and a pressure roller while heating the hot roller and the pressure roller, and the roller temperature control method includes a temperature detection step of detecting a temperature of at least one of the hot roller and the pressure roller, and a heating control step of controlling heating of the hot roller and the pressure roller based on the temperature detected in the temperature detection step, in which details of the heating control of the hot roller and of the pressure roller in the heating control step are changed in accordance with an operation state, a standby state, or an installation environment of the image forming apparatus.

For example, the fixing apparatus may be provided with a hot roller heater that heats the hot roller and a pressure roller heater that heats the pressure roller, and when the image forming apparatus is in the standby state, and the installation environment is a low-temperature and low-humidity environment, power distribution to the respective heaters may be controlled with priority in the order of the hot roller heater and then the pressure roller heater.

In addition, the fixing apparatus may be provided with an external heating apparatus that can be moved so as to come in contact with or move away from a surface of the hot roller and that heats the surface of the hot roller when in contact with the hot roller. When in the standby state and the installation environment is a low-temperature and low-humidity environment, the external heating apparatus may be separated from the surface of the hot roller, and power distribution to the external heating apparatus interrupted.

Furthermore, when the image forming apparatus is in the standby state and the installation environment is a low-temperature and low-humidity environment, a rotation of the hot roller and of the pressure roller may be stopped, and a rotation of an exhaust fan of the image forming apparatus may be reduced or stopped.

In addition, when the operation state is a state in which printing on a last sheet of recording paper in a print job is complete, heating of the hot roller and the pressure roller may be stopped.

Furthermore, the fixing apparatus may be provided with a hot roller heater that heats the hot roller and a pressure roller heater that heats the pressure roller, and restoration of heating of the hot roller and of the pressure roller may be performed by resuming power distribution to the respective heaters in the order of the hot roller heater and then the pressure roller heater.

In addition, the timing for initiating restoration of heating of the hot roller and of the pressure roller may be at a time when a detected temperature of at least one of the hot roller and the pressure roller declines to a prescribed value.

Furthermore, the prescribed value may be a lower limit temperature of a melting temperature range of toner on recording paper.

In addition, heating of the hot roller and the pressure roller may be controlled so that a temperature of the hot roller and of the pressure roller becomes a standby temperature when the operation state is a state in which printing on recording paper is interrupted.

Interruptions in the printing on recording paper are caused, for example, by process control of the printing process portion, toner replenishment, and feed interruption of recording paper.

In addition, when printing is resumed, the temperature of the hot roller and of the pressure roller that was set prior to the interruption in printing may be returned to a standard value.

Furthermore, heating of the hot roller and the pressure roller may be controlled according to at least one of a size and a basic weight of the recording paper when the operation state is a state in which printing on recording paper is being executed.

Alternatively, an image forming apparatus according to the present invention is provided with a printing process portion (printing process means) that forms a toner image on recording paper; a fixing apparatus that fixes the toner image on the recording paper by sandwiching the recording paper between a hot roller and a pressure roller while heating the hot roller and the pressure roller; a temperature detector that detects a temperature of at least one of the hot roller and the pressure roller, and a control portion that controls heating of the hot roller and the pressure roller based on a temperature detected by the temperature detector, and changes details of the heating control of the hot roller and of the pressure roller in accordance with an operation state, a standby state, or an installation environment of the image forming apparatus.

According to the present invention described above, details of the heating control of the hot roller and of the pressure roller are changed in accordance with the operation state, standby state, or installation environment of the image forming apparatus.

Here, when the temperature control of the heaters of the hot roller and of the pressure roller and others is set to be switched in a complicated way, unexpected and inappropriate changes can sometimes occur in the surface temperature of the rollers. The unexpected and inappropriate changes occur when the operation state, standby state, or installation environment of the image forming apparatus changes. Thus, details of the heating control of the hot roller and of the pressure roller are changed in accordance with these states and the installation environment. By doing so, it is possible to prevent inappropriate changes in the surface temperature of the rollers.

For example, when in the standby state and the installation environment is a low-temperature and low-humidity environment, power distribution to the respective heaters is controlled with priority in the order of the hot roller heater and then the pressure roller heater. In the standby state in a low-temperature and low-humidity environment, although the assumption is that, while cutting back on the power consumed by the hot roller heater and the pressure roller heater, the surface temperature of the heaters is controlled to prevent the surface temperature of the rollers from becoming too low, in order to better secure fixing of the toner on the recording paper when a printing process is initiated, the surface temperature of the hot roller needs to be higher than the surface temperature of the pressure roller. For this reason, priority is given to the control of the surface temperature of the hot roller. Thus, when a printing process has been initiated, it possible to promptly raise the surface temperature of the hot roller to the appropriate job temperature, and at the same time, to prevent excessive declines in the surface temperature of the pressure roller.

In addition, when in the standby state and the installation environment is a low-temperature and low-humidity environment, the external heating apparatus is separated from the surface of the hot roller, and power distribution to the external heating apparatus is interrupted. The external heating apparatus is for supplementing heating of the surface of the hot roller in a printing process. However, in the standby state in a low-temperature and low-humidity environment, since heat applied to the surface of the hot roller with the external heating apparatus raises the surface temperature of the hot roller sufficiently, heat applied to the entire hot roller with the hot roller heater will be suppressed to cause a lack of heating of the entire hot roller. If a printing process is initiated in this state, the amount of heat is readily deprived from the surface of the hot roller when recording paper comes in contact therewith to cause a decline in the surface temperature of the hot roller, which can cause fixing deficiencies. For this reason, in the standby state in a low-temperature and low-humidity environment, application of heat with the external heating apparatus is stopped so that the hot roller heater only applies heat to the entire hot roller. This makes it possible to maintain the surface temperature of the hot roller and to prevent fixing deficiencies when a printing process is initiated.

Furthermore, when in the standby state and the installation environment is a low-temperature and low-humidity environment, rotation of the hot roller and of the pressure is stopped, and rotation of the exhaust fan of the image forming apparatus is reduced or stopped. Since the hot roller heater is controlled with priority in the standby state in a low-temperature and low-humidity environment, if the hot roller and the pressure roller are rotated, the surface of the pressure roller is heated by the hot roller, causing a state in which the surface of the pressure roller is mainly heated when viewed in terms of the entire pressure roller. If a printing process is initiated in this state, fixing deficiencies occur since the amount of heat is readily deprived from the surface of the pressure roller when recording paper comes in contact therewith. For this reason, in the standby state in a low-temperature and low-humidity environment, the rotation of the hot roller and of the pressure roller is stopped so as to suppress the thermal conduction from the hot roller to the pressure roller so that the entire pressure roller is sufficiently heated by the pressure roller heater. This makes it possible to maintain the surface temperature of the pressure roller when a printing process is initiated.

In addition, since rotation of the exhaust fan of the image forming apparatus is reduced or stopped in the standby state in a low-temperature and low-humidity environment, heat release from the hot roller and from the pressure roller caused by air convection is suppressed so that the surface temperatures of the hot roller and of the pressure roller do not easily decline. Or else, air convection is suppressed and effects of remaining heat of the external heating apparatus do not reach the surrounding areas.

Secondly, when the operation state is a state in which printing on the last sheet of recording paper in a print job is complete, heating of the hot roller and the pressure roller is stopped. Since the amount of heat will not be deprived from the hot roller and from the pressure roller through contact with recording paper after completion of printing on the last sheet of recording paper, if heating of the hot roller and of the pressure roller is continued, the surface temperature of the hot roller and of the pressure roller will be raised inappropriately. In other words, a surface temperature overshoot will occur. For this reason, when reaching a state in which printing on the last sheet of recording paper is complete, heating of the hot roller and of the pressure roller is stopped to prevent surface temperature overshoots of the rollers.

Restoration of heating of the hot roller and of the pressure roller is performed by resuming power distribution to the heaters in the order of the hot roller heater and then the pressure roller heater. In order to better secure fixing of the toner on the recording paper when a printing process is initiated, the hot roller heater is controlled with priority since the surface temperature of the hot roller needs to be higher than the surface temperature of the pressure roller.

In addition, the timing for initiating restoration of heating of the hot roller and of the pressure roller is at the time when the temperature detected for at least one of the hot roller and the pressure roller declines to the prescribed value. The prescribed value is the lower limit temperature of the melting temperature range of the toner on the recording paper. This makes it possible to maintain the surface temperature of the hot roller and of the pressure roller higher than the lower limit temperature of the melting temperature range of the toner, and to promptly raise the surface temperature of the hot roller and of the pressure roller to an appropriate temperature in the melting temperature range of the toner.

Next, while the operation state is a state in which printing on recording paper is being interrupted, heating of the hot roller and of the pressure roller is stopped. The operation state of interrupted printing on recording paper is caused, for example, by process control of the printing process portion, toner replenishment, and feed interruption of recording paper.

Since the amount of heat is not deprived from the hot roller and from the pressure roller through contact with recording paper when the operation state is a state in which printing on recording paper is being interrupted, if heating of the hot roller and of the pressure roller is continued, surface temperature overshoots occur for the hot roller and the pressure roller. For this reason, surface temperature overshoots of the rollers are prevented by controlling heating of the hot roller and the pressure roller so that the temperature of the hot roller and of the pressure roller becomes the standby temperature.

In addition, when printing is resumed, the temperature of the hot roller and of the pressure roller that was set prior to the printing interruption is returned to the standard value. While printing is executed, the larger the number of sheets of recording paper to be printed is, the higher the temperature of the hot roller and of the pressure roller is set to prevent fixing deficiencies. However, if heating of the hot roller and the pressure roller is controlled when interrupted printing is resumed so that the high temperature prior to printing interruption is restored, the temperature of the hot roller and of the pressure roller becomes too high and causes fixing deficiencies. For this reason, the temperature of the hot roller and of the pressure roller is returned to the standard value.

Next, when the operation state is a state in which printing on recording paper is being executed, heating control is performed on the hot roller and on the pressure roller in accordance with at least one of the size and the basic weight of the recording paper. While printing is executed, the amount of heat that is deprived from the hot roller and from the pressure roller when recording paper comes in contact therewith varies depending on the size and basic weight of the recording paper. For this reason, heating of the rollers is controlled in accordance with the size and basic weight of recording paper so that the surface temperature of the rollers is maintained.

BRIEF DESCRIPTION OF THE DRAWINGS

FIG. 4 is a table showing an appropriate job temperature and a standby temperature of a center surface temperature Ta and an edge surface temperature Tb of the hot roller, a surface temperature Tc of the pressure roller, and a surface temperature Td of an endless heating belt.

FIG. 5 is a table showing a correction table for the appropriate job temperature of a center surface of the hot roller.

DESCRIPTION OF THE PREFERRED EMBODIMENTS

Hereinafter, embodiments of the present invention are described in detail with reference to the accompanying drawings.

Figure 1:
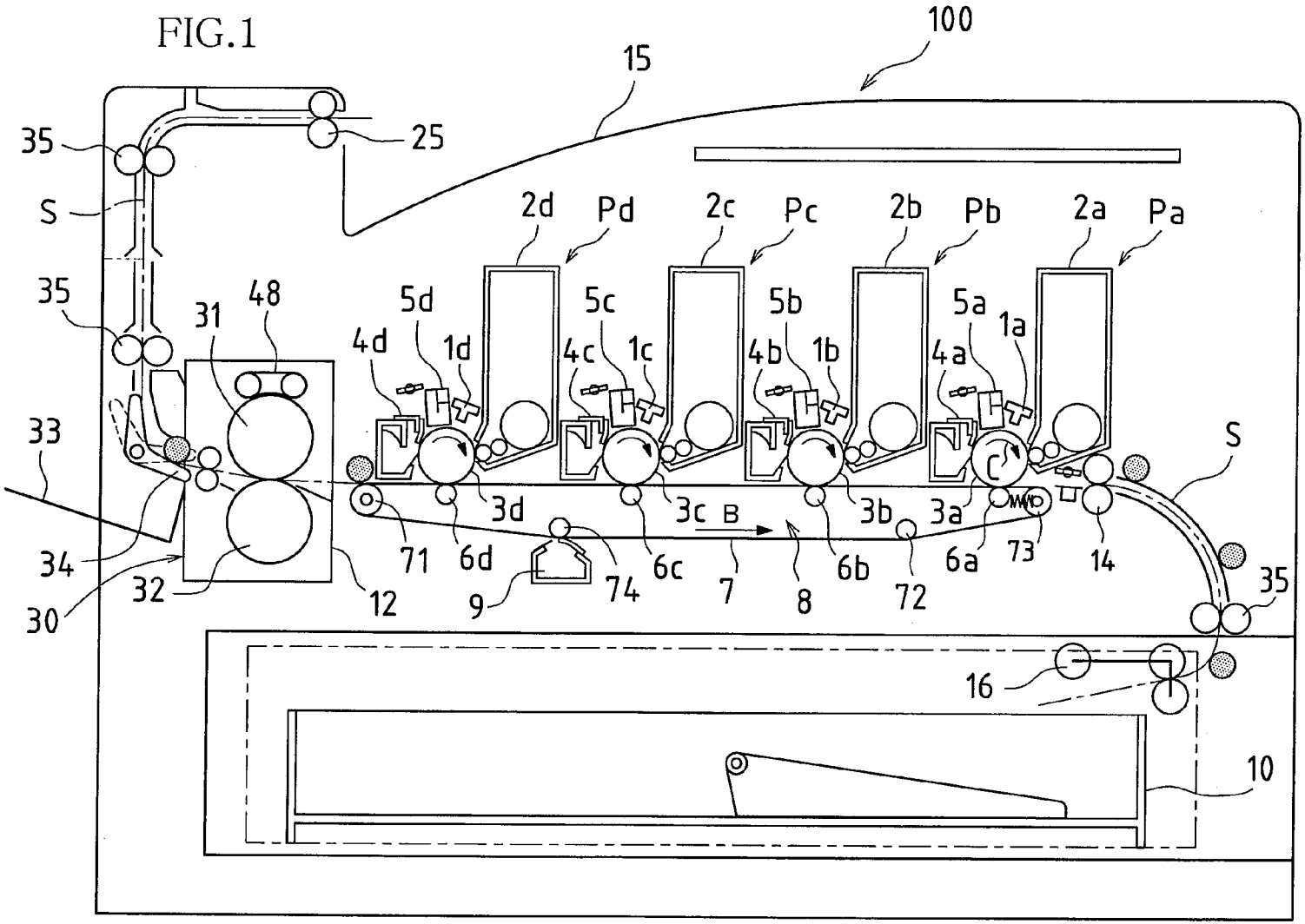
FIG. 1 is a side view of an image forming apparatus in which one embodiment of a roller temperature control method according to the present invention has been applied.

FIG. 1 is a side view of an image forming apparatus in which one embodiment of a roller temperature control method according to the present invention has been applied. An image forming apparatus 100 receives image data transmitted from outside and forms a color or monochrome image specified by the image data on recording paper.

In this image forming apparatus 100, color image data that specifies an image composed of black (K), cyan (C), magenta (M), and yellow (Y) colors is handled, and if the image is composed of other colors, the image data is used after applying to the image data a process of converting the said other colors to black, cyan, magenta, and yellow.

The image forming apparatus 100 is provided with image forming stations Pa to Pd, a transfer/transport belt unit 8, a fixing apparatus 30, a paper transport path S, paper feed tray 10, and discharge trays 15 and 33.

The transfer/transport belt unit 8 is disposed in the approximate center within the image forming apparatus 100, and its top face is held approximately horizontally by spanning an endless transfer/transport belt 7 in a tensioned loop state with a drive roller 71, a tension roller 73, and idler rollers 72 and 74. The transfer/transport belt 7 is a film with a thickness between 100 mm and 150 mm made in an endless state. The transfer/transport belt 7 is rotated in a direction of an arrow B by the rotation of the drive roller 71 so that recording paper is transported through electrostatic suction thereof to the top face of the loop. In addition, the bottom face of this looped transfer/transport belt 7 is cleaned with a cleaner 9. This is to remove the toner attached to the transfer/transport belt 7 when it came in contact with photosensitive drums 3*a* to 3*d* so that contamination of the back face of recording paper is prevented.

The image forming stations Pa to Pd are disposed side by side along the top face of the looped transfer/transport belt 7. The image forming stations Pa to Pd share the same configuration, and form images of electrophotography type based on image data in black (K), cyan (C), magenta (M), and yellow (Y) colors.

As an example, in the image forming station Pa, a charging unit 5*a*, an exposing unit 1*a*, a development unit 2*a*, a transfer roller 6*a*, and a cleaner unit 4*a* are disposed in order around the photosensitive drum 3*a* along the rotation direction of the photosensitive drum 3*a*.

The photosensitive drum 3*a* has a photosensitive layer that has a photoconductive function on the surrounding face and is rotationally driven in the direction shown with an arrow C. The charging unit 5*a* uniformly charges the surface of the photosensitive drum 3*a* to a predetermined electric potential by means of a roller or brush contact type or a corona discharge charger type. The exposing unit 1*a* is a writing head in which an array of light emitting elements such as EL or LED are disposed in the rotating axial direction (main scanning direction) of the photosensitive drum 3*a* or a laser scanning unit (LSU) that deflects the laser beam radiated from a semiconductor laser in a main scanning direction with a rotating multi-faced mirror, and exposes the surface of the photosensitive drum 3*a* with the beam modulated based on black image data. This exposure forms an electrostatic latent image on the surface of the photosensitive drum 3*a*.

The development unit 2*a* supplies black toner to the surface of the photosensitive drum 3*a* on which the electrostatic latent image has been formed, and develops a black toner image from the electrostatic latent image.

The transfer roller 6*a* faces the photosensitive drum 3*a* with interposition of the transfer/transport belt 7, and the high voltage of polarity opposite to the polarity of electrification of the toner is applied. For example, the transfer roller 6*a* is a roller with a diameter of 8 to 10 mm made of metal such as stainless, the surface of which is covered with a conductive and elastic material made of a material such as EPDM, urethane foam, and others, and applies a uniform high voltage to the recording paper that has been electrostatically sucked on the transfer/transport belt 7 so that the toner image carried on the surface of the photosensitive drum 3*a* is transferred onto the surface of the recording paper. The transfer roller 6*a* may be in a configuration of a brush.

The cleaner unit 4*a* recovers the toner and paper powder remaining on the surface of the photosensitive drum 3*a* that has passed through the position facing to the transfer roller 6*a*.

The other image forming stations Pb to Pd also form images based on the image data in cyan, magenta, and yellow like with the image forming station Pa. In other words, each of the exposing units 1*b* to 1*d* is provided with image data in cyan, magenta, and yellow so that the surfaces of the photosensitive drums 3*b* to 3*d* are exposed with the respective beams that have been modulated based on the image data in each color; the electrostatic latent images on the surfaces of the photosensitive drums 3*b* to 3*d* are developed with cyan, magenta, and yellow toners of the development units 2*b* to 2*d*; and the cyan, magenta, and yellow toner images on the surfaces of the photosensitive drums 3*b* to 3*d* are sequentially transferred to recording paper on the transfer/transport belt 7 with the respective transfer rollers 6*b* to 6*d*.

The paper feed tray 10 stores a plurality of sheets of recording paper and is installed below the image forming apparatus 100 in a way it can be freely attached and detached. In addition, the paper transport path S is formed in the image forming apparatus 100. The paper transport path S runs from the paper feed tray 10 to the fixing apparatus 30 through the top face of the looped transfer/transport belt 7, and further to the discharge tray 33 installed on a side of the image forming apparatus 100 or to the discharge tray 15 on top of the image forming apparatus 100 after passing through the fixing apparatus 30. A pickup roller 16, transport rollers 35, PS rollers 14, a transport direction switching guide 34, discharge rollers 25 and others are disposed in the paper transport path S.

The discharge tray 33 stores the recording paper on which images have been formed with the face having the images formed thereon facing upward. The discharge tray 15 stores the recording paper on which images have been formed with the face having the images formed thereon facing downward. The transport direction switching guide 34 is rotated back and forth so that the discharge position of recording paper is switched selectively between the discharge tray 33 and the discharge tray 15.

The transport rollers 35 are small-sized rollers for transporting recording paper, and a plurality of pairs thereof are provided along the paper transport path S. The pickup roller 16 is disposed facing the top face of the recording paper stored in the paper feed tray 10, and picks up the recording paper one by one from the paper feed tray 10 and guides them to the paper transport path S. The PS rollers 14 hold the recording paper picked up from the paper feed tray 10 temporarily at the upstream side of the transfer/transport belt 7, and then send out the recording paper to the transfer/transport belt 7 at the timing synchronized with the rotation of the photosensitive drums 3*a* to 3*d*.

More specifically, the rotation of the PS rollers 14 is temporarily stopped at a timing when recording paper is fed from the paper feed tray 10, and resumed at a timing when the leading edge of the recording paper coincides with the leading edges of the toner images on the surfaces of the photosensitive drums 3*a* to 3*d* at transfer locations between the photosensitive drums 3*a* to 3*d* and the corresponding transfer rollers 6*a* to 6*d*. Thus, the black, cyan, magenta, and yellow toner images on the surfaces of the photosensitive drums 3*a* to 3*d* are superposed on a single sheet of recording paper without misalignment.

The fixing apparatus 30 is provided with a pair of a hot roller 31 and a pressure roller 32. The rollers 31 and 32 are pressed against each other with a predetermined pressing force so that they are rotationally driven in a single direction while their surface temperature is controlled to be at a prescribed fixing temperature at which the toner can be melted. In a nip region, heat and pressure are applied to the recording paper to which a toner image has been transferred while the recording paper is transported through the nip region between the rollers 31 and 32. This melts and solidly fixes the toner images on the recording paper. The black, cyan, magenta, and yellow toner images transferred onto a single sheet of recording paper become a color image through subtractive mixture of color.

In order to form such a full-color image, image formation is performed at all of the four image forming stations Pa to Pd.

In addition, it is also possible to form a monochrome image. For formation of a monochrome image, among the four image forming stations Pa to Pd, image formation is only performed at the image forming station that corresponds to the color of the image to be formed. The transport process of the recording paper and fixing of the image on the recording paper by the fixing apparatus 30 are the same as that for a color image.

In the image forming apparatus 100 like this, user-friendliness is improved by increasing the printing processing speed. For example, when using standard A4 size recording paper, the transport speed of the recording paper for color printing process is set to 41 sheets/minute (a processing speed of 225 mm/sec) and the transport speed of the recording paper for monochrome printing process is set to 70 sheets/minute (a processing speed of 350 mm/sec).

When the transport speed of the recording paper or the processing speed is increased, the fixing apparatus 30 has a tendency to be unable to give a sufficient amount of heat to the recording paper that passes through the nip region between the hot roller 31 and the pressure roller 32, and so the surface temperature of the rollers 31 and 32 declines. If these problems are not addressed, deficiencies in the fixing of the toner image on the recording paper occur.

For this reason, in the fixing apparatus 30, a built-in heater is provided within each of the rollers 31 and 32 so that heat is applied to the rollers 31 and 32. In addition, an external heating unit 48 is provided to apply heat to the hot roller 31 externally so that the hot roller 31 is directly heated with the external heating unit 48 and so that the pressure roller 32 is indirectly heated with the thermal conduction between the rollers 31 and 32, thus reducing a decline in the surface temperature of the rollers 31 and 32 and maintaining the surface temperature thereof at a prescribed fixing temperature.

Figure 2:
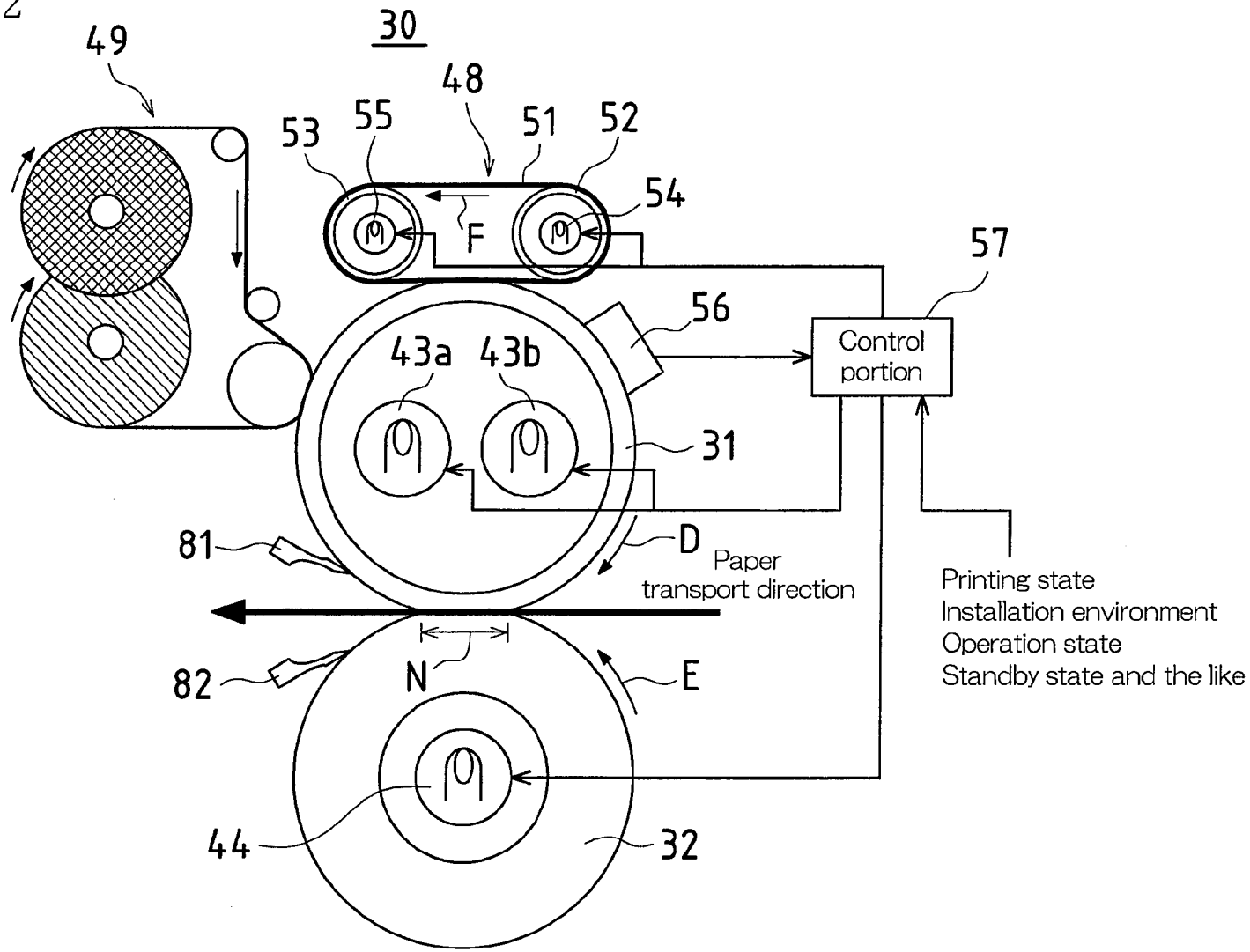
FIG. 2 is a cross-sectional view that illustrates a hot roller and a pressure roller of a fixing apparatus of the image forming apparatus according to the present invention.

FIG. 2 is a cross-sectional view that schematically illustrates the fixing apparatus 30, viewed from the side. The fixing apparatus 30 is provided with a hot roller 31, a pressure roller 32, an external heating unit 48 that applies heat to the hot roller 31 externally, a cleaning apparatus 49 for removing the toner that has attached to the surface of the hot roller 31, and separation claws 81 and 82 respectively provided at a surface of the rollers 31 and 32.

The rollers 31 and 32 press against each other with a predetermined pressing force (for example, 600 N) and a nip region N is formed between the rollers 31 and 32. The length of the nip region N (the length along the rotation direction of the rollers 31 and 32) is set to 9 mm for example. The rollers 31 and 32 rotate while being heated to a prescribed fixing temperature (for example 180° C.) and a toner image on recording paper P that passes through the nip region N is thermally fused.

The hot roller 31 is a roller having a three-layer construction in which an elastic layer is provided on the outer surface of the core and a mold release layer is formed on the outer surface of the elastic layer. A metal such as iron, stainless steel, aluminum, bronze, an alloy of these and the like is used for the core. Furthermore, a silicone rubber is used for the elastic layer, and a fluorocarbon resin such as PFA (a copolymer of tetrafluoroethylene and perfluoroalkyl vinyl ether) and PTFE (polytetrafluoroethylene) is used for the mold release layer.

A main heater lamp 43*a* and a sub-heater lamp 43*b* serving as a heat source that applies heat to the roller 31 are provided inside of the hot roller 31 (inside of the core). The main heater lamp 43*a* applies heat mainly to the center region in the longitudinal direction of the hot roller 31, and the sub-heater lamp 43*b* is parted to both edge sides of the hot roller 31 and applies heat mainly to the region of both edge sides of the hot roller 31.

The pressure roller 32 is also a roller having a three-layer construction equivalent to the hot roller 31 and is constituted of a core made of a metal such as iron, stainless steel, aluminum, bronze, an alloy of these and the like, an elastic layer made of a silicone rubber or the like on the surface of the core, and further still a mold release layer thereon made of PFA or PTFE or the like.

Furthermore, a heater lamp 44 that heats the roller 32 is also provided inside the pressure roller 32 (inside of the core).

The heater lamps 43*a* and 43*b* of the hot roller 31 and the heater lamp 44 of the pressure roller 32 are controlled on-off, and infrared rays are radiated during ON times to heat the rollers 31 and 32 respectively. The rollers 31 and 32 are heated from within so that their surfaces are uniformly heated.

The external heating unit 48 is provided with an endless external heating belt 51 and a pair of external hot rollers 52 and 53. The endless external heating belt 51 spans in a tensioned state between the external hot rollers 52 and 53.

The endless external heating belt 51 is a belt having a two-layer construction in which a mold release layer made of a synthetic resin material having excellent heat resistance and releasability (a fluorocarbon resin such as PFA and PTFE for example) is formed on the surface of a hollow cylindrical base material made of a heat resistant resin such as polyimide or a metal material such as stainless steel or nickel. A coating of fluorocarbon resin or the like may be provided on an inner surface of the belt base material to reduce the exertive force of the endless external heating belt 51.

The external hot rollers 52 and 53 are hollow cylindrical metal core materials made of aluminum, ferrous material or the like. A coating of fluorocarbon resin or the like may be provided on the surface of the metal core material to reduce the exertive force of the endless external heating belt 51.

In addition, heater lamps 54 and 55 are provided inside the external hot rollers 52 and 53 respectively to heat the rollers 52 and 53. The heater lamps 54 and 55 are controlled on-off and infrared rays are radiated during ON times to heat the rollers 52 and 53 respectively. The rollers 52 and 53 are heated from within so that their surfaces are uniformly heated. Then, heat is transferred from the surfaces of the rollers 52 and 53 to the endless external heating belt 51, and the entire endless external heating belt 51 is uniformly heated when the endless external heating belt 51 rotates with the rollers 52 and 53.

Furthermore, the external heating unit 48 has a displacement mechanism for displacing the endless external heating belt 51 relative to the hot roller 31 so that the endless external heating belt 51 is put in contact with or spaced from the hot roller 31. This displacement mechanism is driven by a motor and a power transmission structure (not shown in drawings) or the like.

Here, the shaft of the hot roller 31 is rotationally driven by the motor and power transmission structure (not shown in drawings) or the like so that it rotates in the direction indicated with an arrow D. Due to being in pressed contact with the hot roller 31, the pressure roller 32 is idly rotated in the direction indicated with an arrow E. In addition, the endless external heating belt 51 of the external heating unit 48 is idly rotated in the direction indicated with an arrow F when it is in contact with the hot roller 31. In this way, the hot roller 31, the pressure roller 32, and the endless external heating belt 51 rotate in synchronization with each other.

Meanwhile, thermistors 56 are respectively disposed on the surface in the center of the hot roller 31 and the surface of one of the edges of the hot roller 31, and these thermistors 56 detect the center surface temperature and the edge surface temperature of the hot roller 31.

A control portion 57 performs on-off control of the heater lamps 43*a* and 43*b* of the hot roller 31, the heater lamp 44 of the pressure roller 32, and the heater lamps 54 and 55 of the external hot rollers 52 and 53 based on the surface temperature of the hot roller 31 detected by the thermistors 56 so that the surface temperature of the hot roller 31, the surface temperature of the pressure roller 32, and the surface temperature of the endless external heating belt 51 are regulated. In this way, the surface temperature of the rollers 31 and 32 is appropriately controlled and the toner image on the recording paper can be reliably fixed.

Although the thermistors 56 detect only the surface temperature of the hot roller 31, since there are a certain thermal conduction between the hot roller 31 and the pressure roller 32 and a certain thermal conduction between the hot roller 31 and the endless external heating belt 51, if the heater lamps 43*a* and 43*b* of the hot roller 31, the heater lamp 44 of the pressure roller 32, and the heater lamps 54 and 55 of the external hot rollers 52 and 53 are controlled on-off in accordance with their respective duty ratios so that the surface temperature of the hot roller 31 becomes the appropriate job temperature, the surface temperature of the pressure roller 32 and of the endless external heating belt 51 can be roughly regulated to and maintained at the appropriate job temperature.

In addition, the control portion 57 performs rotation drive control of the rollers 31 and 32 of the fixing apparatus 30. Furthermore, the control portion 57 controls the motor that drives the displacement mechanism of the external heating unit 48 so that the endless external heating belt 51 of the external heating unit 48 can come in contact with or move away from the hot roller 31.

In the fixing apparatus 30, the amount of heat deprived from the rollers 31 and 32 through contact with recording paper varies depending on the size of the recording paper, the transport speed of the recording paper, color printing process, monochrome printing process, and the like. For this reason, in order to appropriately maintain the surface temperature of the rollers 31 and 32, the control method of the heater lamps 43*a* and 43*b* of the hot roller 31, the heater lamp 44 of the pressure roller 32, and the heater lamps 54 and 55 of the external hot rollers 52 and 53 need to be switched in a complicated manner.

For example, since the appropriate job temperature of the rollers 31 and 32 is different between color printing processes and monochrome printing processes, the control method of the heater lamps 43*a*, 43*b*, 44, 54, and 55 is different as well.

However, such complication of heater control can sometimes change the surface temperature of the rollers 31 and 32 of the fixing apparatus 30 unexpectedly and inappropriately. These unexpected and inappropriate changes happen when there is a change in various operation state or standby state of the image forming apparatus 100 or in the installation environment of the image forming apparatus 100.

In this embodiment, the operation state, standby state, or installation environment of the image forming apparatus 100 is detected or determined so that details of heating control of the surface temperature of the rollers 31 and 32 of the fixing apparatus are changed in accordance with the detected or determined state or environment. For example, when the operation state is a state in which printing on a last sheet of recording paper in a print job is complete, or when the operation state is a state in which printing on recording paper is being interrupted, or when the installation environment is a low-temperature and low-humidity environment and in the standby state, heating control is selectively performed to prevent unexpected and inappropriate changes in the surface temperature of the rollers 31 and 32.

Next, details of heating control of the surface temperature of the rollers 31 and 32 in accordance with the respective states will be described.

First, when the operation state is in a status in which printing on a last sheet of recording paper in a print job is complete will be described.

The control portion 57 monitors the remaining number of sheets of recording paper to be subject to the printing process in the print job assigned to the image forming apparatus 100. The control portion 57 determines that printing on the last sheet of recording paper is complete when the remaining number of sheets of recording paper turns to 0, and turns off power distribution to the heater lamps 43*a* and 43*b* of the hot roller 31, the heater lamp 44 of the pressure roller 32, and the heater lamps 54 and 55 of the external hot rollers 52 and 53.

Since the amount of heat will not be deprived from the hot roller 31 and from the pressure roller 32 through contact with recording paper after completion of printing on the last sheet of recording paper, if heating of the rollers 31 and 32 is continued, the surface temperature of the rollers 31 and 32 will be raised inadequately, in other words, a surface temperature overshoot will occur. For this reason, when printing on the last sheet of recording paper is complete, the heater lamps 43*a*, 43*b*, 44, 54, and 55 are turned off and heating of the rollers 31 and 32 is stopped so as to prevent the surface temperature overshoot of the rollers 31 and 32.

If heating of the hot roller 31 and of the pressure roller 32 is left stopped, the surface temperature of the rollers 31 and 32 declines too much and the surface temperature of the rollers 31 and 32 cannot be readily raised to their corresponding appropriate job temperature when heating of the rollers 31 and 32 is resumed for the following printing job, causing fixing deficiencies. For this reason, heating of the rollers 31 and 32 is restored at an appropriate timing.

The timing for initiating restoration of heating of the hot roller 31 and of the pressure roller 32 is at the time when the surface temperature of the pressure roller 32 declines to the lower limit temperature of the melting temperature range of the toner.

Here, since the surface temperature of the hot roller 31 (for example, the average value of the center surface temperature and the edge surface temperature) and the surface temperature of the pressure roller 32 are interrelated, when the surface temperature of the hot roller 31 declines to a prescribed value, it can be assumed that the surface temperature of the pressure roller 32 has declined to a certain value.

Thus, the time when the surface temperature of the pressure roller 32 declines to the lower limit temperature of the melting temperature range of the toner can be determined based on the surface temperature of the hot roller 31 detected by the thermistors 56, and heating of the rollers 31 and 32 can be resumed at this timing.

In addition, heating of the hot roller 31 and of the pressure roller 32 is restored in the order of the main heater lamp 43*a* and the sub-heater lamp 43*b* of the hot roller 31, the heater lamp 44 of the pressure roller 32, and the heater lamps 54 and 55 of the external hot rollers 52 and 53 by resuming power distribution to each of the heater lamps 43*a*, 43*b*, 44, 54, and 55.

In a standby state, the main heater lamp 43*a* of the hot roller 31 is turned with priority over the sub-heater lamp 43*b* since, in order to better secure fixing of the toner on the recording paper when a printing process is started, the center surface temperature of the hot roller 31 should be given priority over the edge surface temperature thereof. In addition, since the surface temperature of the hot roller 31 needs to be higher than the surface temperature of the pressure roller 32, the heater lamps 43*a* and 43*b* of the hot roller 31 are turned on with priority over the heater lamp 44 of the pressure roller 32.

The control portion 57 monitors the surface temperature of the hot roller 31 detected by the thermistors 56, and heating of the rollers 31 and 32 is resumed by turning on the heater lamps 43*a* and 43*b* of the hot roller 31, the heater lamp 44 of the pressure roller 32, and the heater lamps 54 and 55 of the external hot rollers 52 and 53 sequentially at the time when the surface temperature of the hot roller 31 declines to a prescribed value, in other words, at the time when the surface temperature of the pressure roller 32 declines to the lower limit temperature of the melting temperature range of the toner.

Then, the control portion 57 performs on-off control of the heater lamps 43*a* and 43*b* of the hot roller 31, the heater lamp 44 of the pressure roller 32, and the heater lamps 54 and 55 of the external hot rollers 52 and 53 in accordance with the corresponding duty ratio so that the surface temperature of the hot roller 31 becomes the standby temperature. This roughly regulates and maintains the surface temperature of the pressure roller 32 and of the endless external heating belt 51 to and at the respective standby temperatures.

Figure 3:
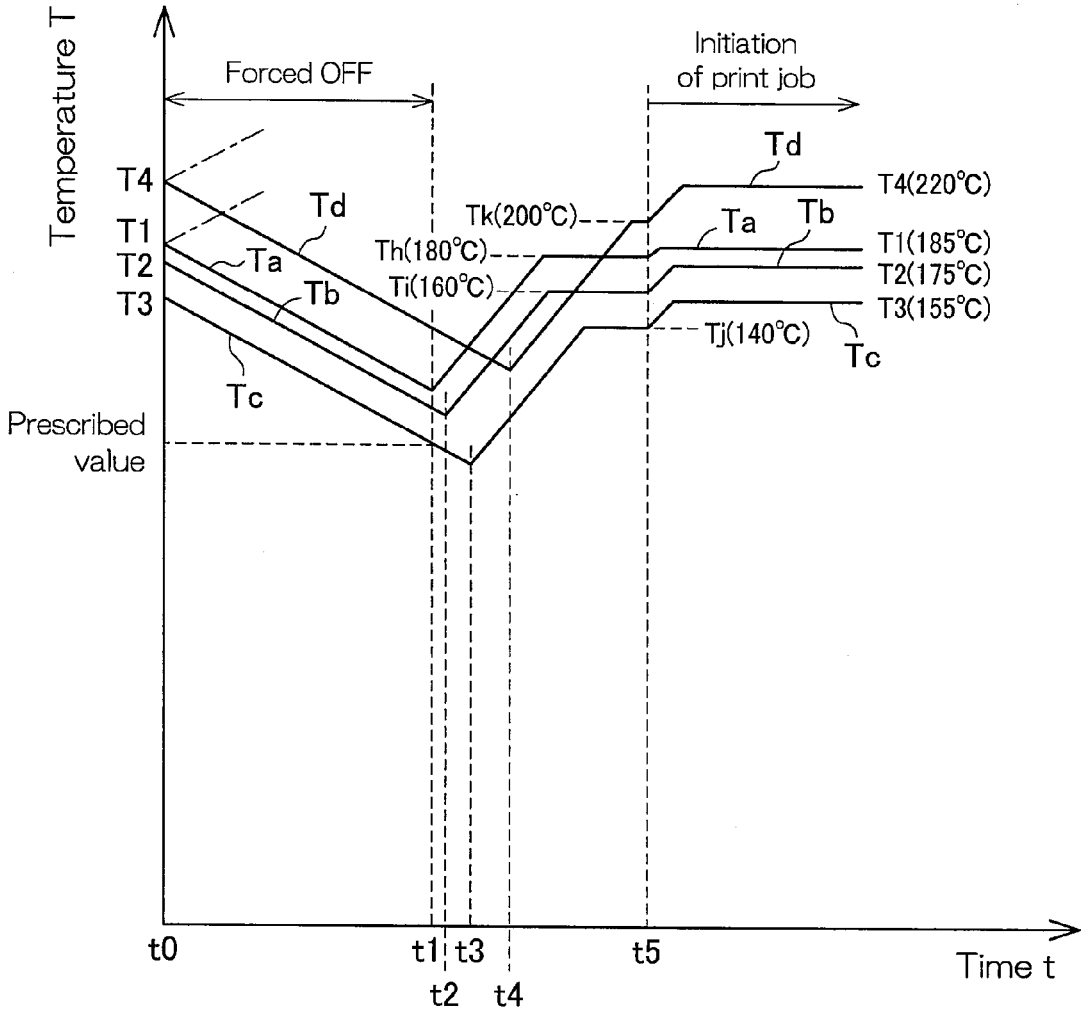
FIG. 3 is a graph showing the timing for initiation of power distribution control of each heater lamp after completion of printing on a last sheet of recording paper.

FIG. 3 is a graph showing the timing for initiation of power distribution control of the heater lamps 43*a*, 43*b*, 44, 54, and 55 after completion of printing on the last sheet of recording paper.

As is evident from the graph in FIG. 3, since the heater lamps 43*a*, 43*b*, 44, 54, and 55 are turned off at a timing t0 when printing on the last sheet of recording paper in a print job is complete, the center surface temperature Ta and an edge surface temperature Th of the hot roller 31, a surface temperature Tc of the pressure roller 32, and a surface temperature Td of the endless external heating belt 51 do not overshoot as shown with dashed lines, but gradually decline as shown with solid lines. Then, at a timing t1 when the surface temperature Tc of the pressure roller 32 declines to the lower limit temperature of the melting temperature range of the toner, the main heater lamp 43*a* of the hot roller 31 is turned on, and at a timing t2, the sub-heater lamp 43*b* of the hot roller 31 is turned on, and furthermore, at a following timing t3, the heater lamp 44 of the pressure roller 32 is turned on, and at a yet later timing t4, the heater lamps 54 and 55 of the external hot rollers 52 and 53 are turned on. For this reason, the center surface temperature Ta of the hot roller 31 starts to rise at the timing t1, the edge surface temperature Tb of the hot roller 31 starts to rise at the timing t2, the surface temperature Tc of the pressure roller 32 starts to rise at the timing t3, and the surface temperature Td of the endless external heating belt 51 starts to rise at the timing t4.

Subsequently, the center surface temperature Ta of the hot roller 31 is maintained at a standby temperature Th, which is slightly lower than an appropriate job temperature T1 of the center surface, a edge surface temperature Tb of the hot roller 31 is maintained at a standby temperature T1, which is slightly lower than an appropriate job temperature T2 (<appropriate job temperature T1) of the edge surface, a surface temperature Tc of the pressure roller 32 is maintained at a standby temperature Tj, which is slightly lower than the appropriate job temperature T3 (<appropriate job temperature T2) of the pressure roller 32, and a surface temperature Td of the endless external heating belt 51 is maintained at a standby temperature Tk, which is slightly lower than the appropriate job temperature T4 (<appropriate job temperature T1) of the endless external heating belt 51. This sets the standby state.

Even in the standby state, the rotational drive of the hot roller 31 is maintained, and the pressure roller 32 and the endless external heating belt 51 are idly rotated.

When printing process of the next print job is initiated at a timing t5, the control portion 57 performs on-off control of the heater lamps 43*a* and 43*b* of the hot roller 31, the heater lamp 44 of the pressure roller 32, and the heater lamps 54 and 55 of the external hot rollers 52 and 53 in accordance with the respective duty ratios so that the center surface temperature Ta and the edge surface temperature Tb of the hot roller 31 detected with the thermistors 56 respectively become the appropriate job temperature. At this time, since the surface temperature of the hot roller 31 was maintained at the standby temperature, which is slightly lower than the appropriate job temperature, until immediately before the timing t5, the surface temperature of the hot roller 31 is promptly raised to and maintained at the appropriate job temperature. At the same time, the surface temperature of the pressure roller 32 and the surface temperature of the endless external heating belt 51 are promptly raised to and maintained at the corresponding appropriate job temperature. This prevents fixing deficiencies in the printing process in the next print job.

Furthermore, while printing is executed, the control portion 57 corrects and makes the appropriate job temperature of the hot roller 31, of the pressure roller 32, and of the endless external heating belt 51 appropriate in accordance with the type and others of the printing process. For example, the appropriate job temperature is respectively corrected and made appropriate in accordance with the color printing process, monochrome printing process, size and basic weight of recording paper, and others. Then, the heater lamps are controlled on-off so that the surface temperature of the hot roller 31, of the pressure roller 32, and of the endless external heating belt 51 is set to the corresponding appropriate job temperature.

When printing on the last sheet of recording paper has been completed in this manner, since the heater lamps 43*a*, 43*b*, 44, 54, and 55 are turned off with heating of the rollers 31 and 32 is stopped, surface temperature overshoots of the rollers 31 and 32 are prevented. Then, since the heater lamps 43*a*, 43*b*, 44, 54, and 55 are turned on sequentially at the timing when the surface temperature of the pressure roller 32 declines to the lower limit temperature of the melting temperature range of the toner to resume heating of the rollers 31 and 32 so that the surface temperature of the hot roller 31, of the pressure roller 32, and of the endless external heating belt 51 is maintained at the corresponding standby temperatures, the surface temperature of the hot roller 31, of the pressure roller 32, and of the endless external heating belt 51 can be promptly raised to the corresponding appropriate job temperature and fixing deficiencies can be prevented when the printing process of the next print job is initiated.

Next, the operation state in which printing on recording paper is being interrupted will be described.

The control portion 57 monitors the operation state of the image forming apparatus 100. For example, while a printing process is executed, initiation of the process control for regulating the toner concentration, toner replenishment to the development apparatus, and feed interruption of recording paper are monitored. In other words, whether or not there is any incidence that may interrupt printing during a printing process is monitored. Then, in case of initiation of process control, toner replenishment, or feed interruption of recording paper while the printing process is executed, the control portion 57 determines that printing is interrupted, and performs on-off control of the heater lamps 43*a* and 43*b* of the hot roller 31, the heater lamp 44 of the pressure roller 32, the heater lamps 54 and 55 of the external hot rollers 52 and 53 in accordance with their respective duty ratios so that the surface temperature of the hot roller 31 returns to the standby temperature. This returns the surface temperature of the pressure roller 32 and of the endless external heating belt 51 to their respective standby temperatures.

For example, as shown in FIG. 4, if the center surface temperature Ta of the hot roller 31 is set to the appropriate job temperature of 185° C., the edge surface temperature Tb portion of the hot roller 31 is set to the appropriate job temperature of 175° C., the surface temperature Tc of the pressure roller 32 is set to the appropriate job temperature of 155° C., and the surface temperature Td of the endless external heating belt 51 is set to the appropriate job temperature of 220° C. while a printing process is executed, the center surface temperature Ta of the hot roller 31 is returned to the standby temperature of 180° C., the edge surface temperature Tb of the hot roller 31 is returned to the standby temperature of 160° C., the surface temperature Tc of the pressure roller is returned to the standby temperature of 140° C., and the surface temperature Td of the endless external heating belt 51 is returned to the standby temperature of 200° C. after printing is interrupted.

In other words, when printing is interrupted, the surface temperature of the hot roller 31, of the pressure roller 32, and of the endless external heating belt 51 is respectively returned from the appropriate job temperature to the standby temperature. In this way, surface temperature overshoots of the hot roller 31, of the pressure roller 32, and of the endless external heating belt 51 are prevented.

In addition, the control portion 57 returns the appropriate job temperature that was set for the hot roller 31, for the pressure roller 32, and for the endless external heating belt 51 prior to interruption in printing to the standard value respectively. Then, when the printing process is resumed, the control portion 57 performs on-off control of the heater lamps 43*a* and 43*b* of the hot roller 31, the heater lamp 44 of the pressure roller 32, and the heater lamps 54 and 55 of the external hot rollers 52 and 53 in accordance with their respective duty ratios so that the center surface temperature Ta and the edge surface temperature Tb of the hot roller 31 detected with the thermistors 56 is respectively returned to the standard value. This also returns the surface temperature of the pressure roller 32 and of the endless external heating belt 51 to their respective standard values.

At this time, since the surface temperature of the hot roller 31, of the pressure roller 32, and of the endless external heating belt 51 had been maintained at their standby temperature until immediately before the printing process was resumed, these surface temperatures are promptly raised to and maintained at their respective standard values. In addition, since the respective standard values are set as the appropriate job temperature of the hot roller 31, of the pressure roller 32, and of the endless external heating belt 51, these appropriate job temperatures do not become too high or too low.

Furthermore, while printing is executed, the control portion 57 corrects and makes the appropriate job temperature of the hot roller 31, of the pressure roller 32, and of the endless external heating belt 51 appropriate in accordance with the color printing process, monochrome printing process, size and basic weight of recording paper, and others so that the surface temperatures of the hot roller 31, of the pressure roller 32, and of the endless external heating belt 51 are set respectively at the appropriate job temperature.

If printing is interrupted while a printing process is executed like this, the surface temperatures of the hot roller 31, of the pressure roller 32, and of the endless external heating belt 51 is returned respectively to the standby temperatures so that surface temperature overshoots are prevented, and when the printing process is resumed, the surface temperature of the hot roller 31, of the pressure roller 32, and of the endless external heating belt 51 can be promptly raised to the corresponding appropriate job temperature so as to prevent fixing deficiencies.

In addition, since the appropriate job temperature of the hot roller 31, of the pressure roller 32, and of the endless external heating belt 51 that had been set prior to interruption in printing was returned respectively to the standard value, these appropriate job temperatures do not become too high or too low when the printing process is resumed.

Although the appropriate job temperatures shown in FIG. 4 are standard values, whatever the respective appropriate job temperatures are, when printing is interrupted, the surface temperatures of the hot roller 31, of the pressure roller 32, and of the endless external heating belt 51 is returned from the appropriate job temperature to the standby temperature, and the standard value is set for the appropriate job temperature respectively.

For example, the appropriate job temperature of the center surface of the hot roller 31 is corrected in accordance with the number of sheets of recording paper to be printed in the print job by referring to a correction table similar to the one shown in FIG. 5. Here, if the number of sheets of recording paper to be printed in the print job is 1 or 2, the appropriate job temperature of the center surface of the hot roller 31 is corrected from the standard value of 185° C. to 175° C. If the number of sheets of the recording paper is between 3 and 20, the appropriate job temperature of the center surface of the hot roller 31 is corrected from the standard value of 185° C. to 195° C., and furthermore, if the number of sheets of the recording paper is between 21 and 50 or 51 or more, the appropriate job temperature of the center surface of the hot roller 31 is corrected from the standard value of 185° C. to 200° C. Likewise, the appropriate job temperature for the edge surface of the hot roller 31, for the surface of the pressure roller 32, and for the surface of the endless external heating belt 51 are corrected.

When the number of sheets of the recording paper is between 21 and 50 or 51 or more, the appropriate job temperature is set high for the hot roller 31, and the appropriate job temperature is set extremely high for the pressure roller 32 and for the endless external heating belt 51, but regardless of these appropriate job temperatures, when printing is interrupted, the surface temperature of the hot roller 31, of the pressure roller 32, and of the endless external heating belt 51 is returned respectively to the standby temperature, and the standard value is respectively set for the appropriate job temperature of the hot roller 31, of the pressure roller 32, and of the endless external heating belt 51.

If those high appropriate job temperatures are maintained despite of printing interruption, when the printing process is resumed, the surface temperatures of the hot roller 31, of the pressure roller 32, and of the endless external heating belt 51 will be too high, and fixing deficiencies will occur.

Next, when the installation environment is a low-temperature and low-humidity environment and the image forming apparatus 100 enters the standby state will be explained.

The control portion 57 monitors detection outputs from environment sensors (such as temperature sensor and humidity sensor) that have been provided to the image forming apparatus 100 to monitor whether or not the installation environment for the image forming apparatus 100 is low-temperature and low-humidity environment based on the detection outputs from the environment sensors. In addition, the control portion 57 also monitors whether or not the image forming apparatus 100 is in the standby state.

If the installation environment is a low-temperature and low-humidity environment, and the image forming apparatus 100 is in the standby state, the control portion 57 stops the hot roller 31, the pressure roller 32, and the endless external heating belt 51. In addition, the control portion 57 controls the motor that drives the displacement mechanism of the external heating unit 48 so that the endless external heating belt 51 of the external heating unit 48 is spaced from the hot roller 31.

Furthermore, the control portion 57 turns off the heater lamps 54 and 55 of the external hot rollers 52 and 53, and stops heating of the endless external heating belt 51.

Additionally, the control portion 57 either reduces rotation of an exhaust fan (not shown) of the image forming apparatus 100 or stops the exhaust fan. In a low-temperature and low-humidity environment, since the temperature within the apparatus becomes too low due to ventilation of the image forming apparatus 100, the lowering of the temperature within the apparatus can be mitigated by reducing the rotation of the exhaust fan or by stopping the exhaust fan.

Then, the control portion 57 controls power distribution of the heater lamps 43*a*, 43*b*, and 44 so that the surface temperature of the hot roller 31 and the surface temperature of the pressure roller 32 are maintained at their respective standby temperatures. For example, the heater lamps 43*a*, 43*b*, and 44 are controlled on-off in accordance with their respective duty ratios so that the center surface temperature Ta of the hot roller 31 and the edge surface temperature Tb of the hot roller 31 become their respective standby temperatures of 180° C. and 160° C. This makes the surface temperature Tc of the pressure roller 32 approximately at the standby temperature of 140° C. Since the surface temperature of the hot roller 31 is set to be higher than the surface temperature of the pressure roller 32, the amount of current to the heater lamps 43*a* and 43*b* of the hot roller 31 is more than the amount of current to the heater lamp 44 of the pressure roller 32.

At this time, although the rotation of the hot roller 31 and of the pressure roller 32 has been stopped, since there is a certain thermal conduction between the hot roller 31 and the pressure roller 32, the surface temperature of the pressure roller 32 can be simultaneously roughly regulated and maintained at the standby temperature if the heater lamps 43*a* and 43*b* of the hot roller 31 and the heater lamp 44 of the pressure roller 32 are controlled on-off in accordance with the duty ratio so that the surface temperature of the hot roller 31 is regulated to and maintained at the standby temperature.

If the installation environment is a low-temperature and low-humidity environment and the standby state is triggered like this, since the surface temperature of the hot roller 31 is set to be higher than the surface temperature of the pressure roller 32 and the surface temperature of the pressure roller 32 is maintained at the standby temperature, when the printing process is started, fixing of the toner on the recording paper can be secured.

In addition, since the rotation of the hot roller 31 and of the pressure roller 32 is stopped, the thermal conduction from the hot roller 31 to the pressure roller 32 is suppressed and sufficient heat is applied to the entire pressure roller 32 by the heater lamp 44 of the pressure roller 32. For this reason, it is possible to prevent declines in the temperature of the pressure roller 32 when a printing process is initiated, and fixing deficiencies are prevented.

As mentioned previously, since the surface temperature of the hot roller 31 is set to be higher than the surface temperature of the pressure roller 32, if the hot roller 31 and the pressure roller 32 are rotated, the surface of the pressure roller 32 is heated by the hot roller 31, in other words, by viewing in terms of the entire pressure roller 32, the pressure roller 32 is in a state in which its surface is mainly heated. If a printing process is started in this state, fixing deficiencies are caused since the amount of heat is readily deprived from the surface of the pressure roller 32 through contact with recording paper.

Furthermore, since the endless external heating belt 51 is spaced from the surface of the hot roller 31 and the heater lamps 54 and 55 of the external hot rollers 52 and 53 are turned off, the heater lamps 43 and 43*b* of the hot roller 31 applies sufficient heat to the entire hot roller 31. For this reason, when a printing process is started, decline in the temperature of the hot roller 31 can be prevented.

If the surface of the hot roller 31 is heated with the endless external heating belt 51, the surface temperature of the hot roller 31 rises sufficiently while the heating of the entire hot roller 31 by the heater lamps 43*a* and 43*b* of the hot roller 31 is suppressed to cause lack in the amount of heat for the entire hot roller 31. If a printing process is started in this state, the amount of heat is readily deprived from the surface of the hot roller 31 through contact with recording paper and the surface temperature of the hot roller 31 declines, which causes fixing deficiencies.

Figure 6:
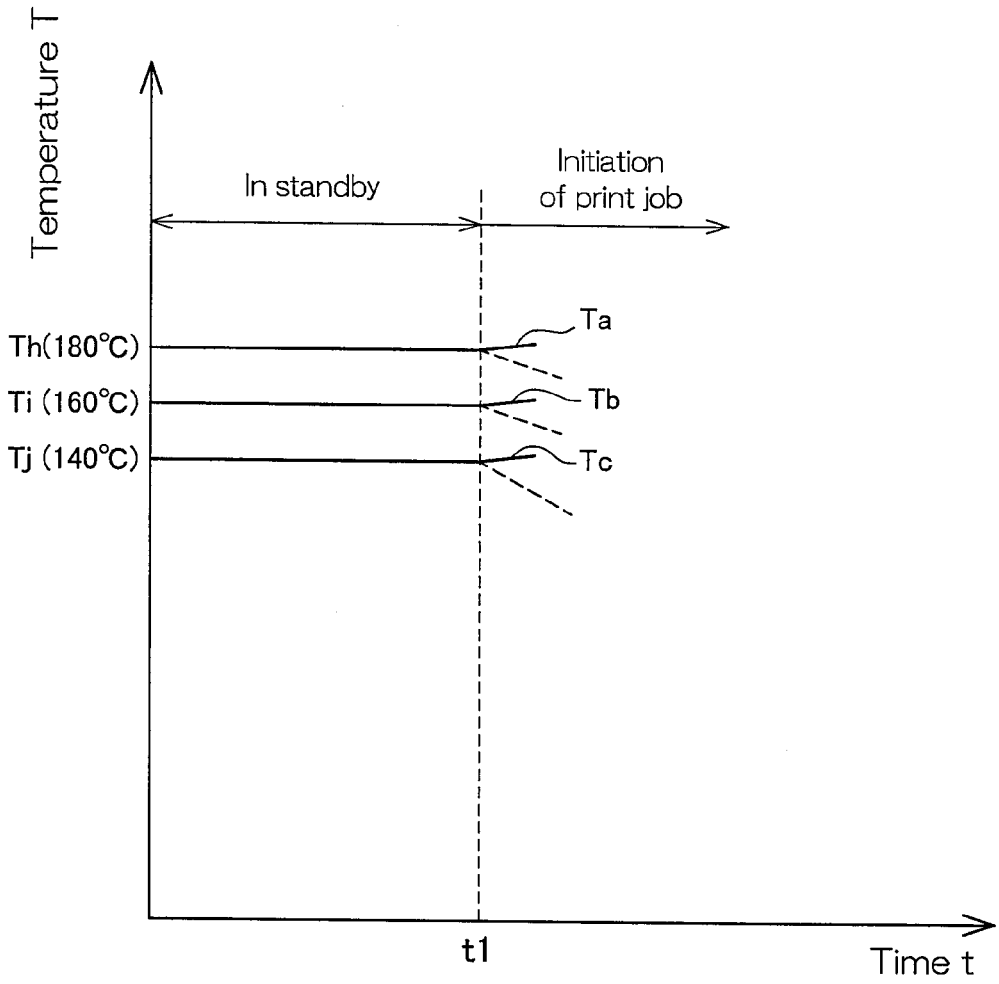
FIG. 6 is a graph showing variations in the surface temperature of the hot roller and of the pressure roller after entering a standby state in a low-temperature and low-humidity environment.

FIG. 6 is a graph showing variations in the surface temperature of the hot roller 31 and of the pressure roller 32 after entering the standby state in a low-temperature and low-humidity environment.

As is evident from the graph in FIG. 6, while in the standby state, the center surface temperature Ta and the edge surface temperature Tb of the hot roller 31 are maintained at their respective standby temperatures Th and Ti and the surface temperature Tc of the pressure roller 32 is maintained at the standby temperature Tj.

When a printing process is started at the timing t1, the rotation of the hot roller 31 and the pressure roller 32 is started, and the heater lamps 43*a* and 43*b* of the hot roller 31 and the heater lamp 44 of the pressure roller 32 are controlled on-off in accordance with their respective duty ratios so that the center surface temperature Ta and the edge surface temperature Tb of the hot roller 31 detected by the thermistors 56 respectively become the appropriate job temperature.

Since the hot roller 31 and the pressure roller 32 are heated as a whole while in the standby state, the surface temperature of the rollers 31 and 32 do not rapidly decline even when recording paper comes in contact with the surface of the rollers 31 and 32, and fixing can be performed stably.

If heat is applied only to the surface of the hot roller 31 and of the pressure roller 32 while in the standby state, as soon as recording paper comes in contact with the surface of the rollers 31 and 32, the surface temperatures Ta and Tb of the hot roller 31 and the surface temperature Tc of the pressure roller 32 decline as shown with broken lines, and fixing deficiencies occur.

In addition, since rotation of the exhaust fan of the image forming apparatus 100 is reduced or stopped, heat release from the hot roller 31 and from the pressure roller 32 due to air convection is suppressed so that the surface temperatures of the hot roller 31 and of the pressure roller 32 do not easily decline.

Furthermore, even when the external hot rollers 52 and 53 have remaining heat after entering the standby state, since rotation of the exhaust fan is reduced or stopped, there are no effects from the remaining heat.

If the rotation of the exhaust fan is maintained, the air heated with the remaining heat of the external hot rollers 52 and 53 is convected to raise the temperatures detected by the thermistors 56 so that it is determined that the surface temperature of the hot roller 31 has sufficiently risen to cause insufficient heating of the hot roller 31 and the pressure roller 32, which causes a decrease in the actual surface temperature of the rollers 31 and 32. Then, if a printing process is started in this state, fixing deficiencies are caused by insufficient surface temperature of the hot roller 31 and of the pressure roller 32.

It should be noted that the present invention is not limited to the above-described embodiment, but includes other various variations. For example, heater lamps of the hot roller and heater lamps of the pressure roller may be increased or decreased. In addition, the external heating unit may be omitted. Furthermore, the surface temperature of rollers and belts may be changed as appropriate depending on the melting temperature of the toner and apparatus environments.

Furthermore, in addition to the hot roller, a sensor for temperature detection may be provided to the pressure roller, the external heating unit, and others, and heating of the pressure roller and the external heating unit may be controlled based on the respective detected temperatures.

The present invention may be embodied in various other forms without departing from the gist and essential characteristics thereof. The embodiments disclosed in this application are to be considered in all respects as illustrative and not limiting. The scope of the invention is indicated by the appended claims rather than by the foregoing description, and all modifications or changes that come within the meaning and range of equivalency of the claims are intended to be embraced therein.

What is claimed is:

1. A roller temperature control method of an image forming apparatus having a printing process portion that forms a toner image on recording paper, a fixing apparatus that is provided with a hot roller heater that heats a hot roller and a pressure roller heater that heats a pressure roller and that fixes the toner image on the recording paper by sandwiching the recording paper between the hot roller and the pressure roller while heating the hot roller and the pressure roller, and an external heating apparatus that can be moved so as to come in contact with or move away from a surface of the hot roller and that heats the surface of the hot roller when in contact with the hot roller, the roller temperature control method comprising:

a temperature detection step of detecting a temperature of at least one of the hot roller and the pressure roller, and a heating control step of controlling heating of the hot roller and the pressure roller based on the temperature detected in the temperature detection step, wherein details of the heating control of the hot roller and of the pressure roller in the heating control step are changed according to an operation state, a standby state, and an installation environment of the image forming apparatus, and when the image forming apparatus is in the standby state and the installation environment is a low-temperature and low-humidity environment, controlling power distribution to the respective heaters with priority in the order of the hot roller heater and then the pressure roller heater, separating the external heating apparatus from the surface of the hot roller, and interrupting power distribution to the external heating apparatus.

2. The roller temperature control method of an image forming apparatus according to claim 1, wherein when the image forming apparatus is in the standby state and the installation environment is a low-temperature and low-humidity environment, a rotation of the hot roller and of the pressure roller is stopped, and a rotation of an exhaust fan of the image forming apparatus is reduced or stopped.

3. The roller temperature control method of an image forming apparatus according to claim 1, wherein when the operation state is a state in which printing on a last sheet of recording paper in a print job is complete, heating of the hot roller and of the pressure roller is stopped.

4. The roller temperature control method of the image forming apparatus according to claim 3, wherein the fixing apparatus is provided with a hot roller heater that heats the hot roller and a pressure roller heater that heats the pressure roller, and restoration of heating of the hot roller and of the pressure roller is performed by resuming power distribution to the respective heaters in the order of the hot roller heater and then the pressure roller heater.

5. The roller temperature control method of an image forming apparatus according to claim 4, wherein the timing for initiating restoration of heating of the hot roller and of the pressure roller is at a time when a detected temperature of at least one of the hot roller and the pressure roller declines to a prescribed value.

6. The roller temperature control method of an image forming apparatus according to claim 5, wherein the prescribed value is a lower limit temperature of a melting temperature range of toner on recording paper.

7. The roller temperature control method of an image forming apparatus according to claim 1, wherein heating of the hot roller and the pressure roller is controlled so that a temperature of the hot roller and of the pressure roller becomes a standby temperature when the operation state is a state in which printing on recording paper is interrupted.

8. The roller temperature control method of an image forming apparatus according to claim 7, wherein the operation state becomes a state in which printing on recording paper is interrupted at the time of process control of the printing process portion, toner replenishment, and feed interruption of recording paper.

9. The roller temperature control method of an image forming apparatus according to claim 7, wherein the temperature of the hot roller and of the pressure roller that was set prior to the interruption in printing is returned to a standard value when printing is resumed.

10. The roller temperature control method of the image forming apparatus according to claim 1, wherein heating of the hot roller and the pressure roller is controlled according to at least one of a size and a basic weight of the recording paper when the operation state is a state in which printing on recording paper is being executed.

11. An image forming apparatus, comprising:

a printing process portion that forms a toner image on recording paper, a fixing apparatus that is provided with a hot roller heater that heats a hot roller and a pressure roller heater that heats a pressure roller and that fixes the toner image on the recording paper by sandwiching the recording paper between a the hot roller and a the pressure roller while heating the hot roller and the pressure roller, an external heating apparatus that can be moved so as to come in contact with or move away from a surface of the hot roller and that heats the surface of the hot roller when in contact with the hot roller, a temperature detector that detects a temperature of at least one of the hot roller and the pressure roller, and a control portion that controls heating of the hot roller and the pressure roller based on the temperature detected by the temperature detector, changes details of the heating control of the hot roller and of the pressure roller in accordance with an operation state, a standby state, and an installation environment of the image forming apparatus, when the image forming apparatus is in the standby state and the installation environment is a low-temperature and low-humidity environment, controls power distribution to the respective heaters with priority in the order of the hot roller heater and then the pressure roller heater, separates the external heating apparatus from the surface of the hot roller, and interrupts power distribution to the external heating apparatus.

12. A roller temperature control method of an image forming apparatus having a printing process portion that forms a toner image on recording paper, a fixing apparatus that fixes the toner image on the recording paper by sandwiching the recording paper between a hot roller and a pressure roller while heating the hot roller and the pressure roller, and an external heating apparatus that can be moved so as to come in contact with or move away from a surface of the hot roller and that heats the surface of the hot roller when in contact with the hot roller, the roller temperature control method comprising:

a temperature detection step of detecting a temperature of the hot roller, and a heating control step of performing on-off control of a hot roller heater that heats the hot roller, a pressure roller heater that heats the pressure roller and an external heating heater that heats the external heating apparatus based on the temperature detected in the temperature detection step, wherein details of the heating control of the hot roller and of the pressure roller in the heating control step are changed according to an operation state, a standby state, and an installation environment of the image forming apparatus, when the image forming apparatus is in the standby state and the installation environment is a low-temperature and low-humidity environment, separating the external heating apparatus from the surface of the hot roller, controlling the temperatures of the hot roller and the pressure roller by performing on-off control of the hot roller heater and the pressure roller heater in accordance with the corresponding duty ratio based on the temperature detected in the temperature detection step, and turning the external heating heater off, and when the image forming apparatus is in the standby state and the installation environment is not a low-temperature and low-humidity environment, contacting the external heating apparatus with the surface of the hot roller, and controlling the temperatures of the hot roller, the pressure roller and the external heating apparatus by performing on-off control of the hot roller heater, the pressure roller heater and the external heating heater in accordance with the corresponding duty ratio based on the temperature detected in the temperature detection step.

13. An image forming apparatus, comprising:

a printing process portion that forms a toner image on recording paper, a fixing apparatus that fixes the toner image on the recording paper by sandwiching the recording paper between a hot roller and a pressure roller while heating the hot roller and the pressure roller, a hot roller heater that heats the hot roller, a pressure roller heater that heats the pressure roller, an external heating apparatus that can be moved so as to come in contact with or move away from a surface of the hot roller and that heats the surface of the hot roller when in contact with the hot roller, an external heating heater that heats the external heating apparatus, a temperature detector that detects a temperature of the hot roller, and a control portion that performs on-off control of the hot roller heater, the pressure roller heater and the external heating heater based on the temperature detected by the temperature detector, and changes details of the heating control of the hot roller and of the pressure roller in accordance with an operation state, a standby state, and an installation environment of the image forming apparatus, wherein when the image forming apparatus is in the standby state and the installation environment is a low-temperature and low-humidity environment, the control portion separates the external heating apparatus from the surface of the hot roller, controls the temperatures of the hot roller and the pressure roller by performing on-off control of the hot roller heater and the pressure roller heater in accordance with the corresponding duty ratio based on the temperature detected by the temperature detector, and turns off the external heating heater, and when the image forming apparatus in the standby state and the installation environment is not a low-temperature and low-humidity environment, the control portion puts the external heating apparatus in contact with the surface of the hot roller, and controls the temperatures of the hot roller, the pressure roller and the external heating apparatus by performing on-off control of the hot roller heater, the pressure roller heater and the external heating heater in accordance with the corresponding duty ratio based on the temperature detected by the temperature detector.

* * * * *